US008258972B2

(12) United States Patent
Wu

(10) Patent No.: US 8,258,972 B2
(45) Date of Patent: Sep. 4, 2012

(54) ELECTRONIC DEVICE AND METHOD TO PREVENT FALLING OF THE ELECTRONIC DEVICE

(75) Inventor: Chien-Hao Wu, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 648 days.

(21) Appl. No.: 12/543,594

(22) Filed: Aug. 19, 2009

(65) Prior Publication Data

US 2010/0109894 A1 May 6, 2010

(30) Foreign Application Priority Data

Oct. 31, 2008 (CN) ..... 2008 1 0305351

(51) Int. Cl.
*G08B 21/00* (2006.01)

(52) U.S. Cl. ..... 340/669; 73/488; 324/162

(58) Field of Classification Search ..... 340/540, 340/669, 670; 73/488, 489; 324/162
See application file for complete search history.

(56) References Cited

U.S. PATENT DOCUMENTS

| | | | | |
|---|---|---|---|---|
| 6,836,212 | B2 * | 12/2004 | Sawinski | 340/539.23 |
| 7,036,628 | B2 * | 5/2006 | Wilcox et al. | 182/9 |
| 7,059,182 | B1 * | 6/2006 | Ragner | 73/200 |
| 7,356,437 | B2 * | 4/2008 | Kobayashi et al. | 702/127 |
| 7,626,355 | B2 * | 12/2009 | Burgan et al. | 320/106 |
| 2010/0049096 | A1 * | 2/2010 | Ten Kate | 600/595 |
| 2012/0050075 | A1 * | 3/2012 | Salmon | 341/20 |

* cited by examiner

*Primary Examiner* — George Bugg
*Assistant Examiner* — Edny Labbees
(74) *Attorney, Agent, or Firm* — Altis Law Group, Inc.

(57) ABSTRACT

An electronic device and method to prevent falling of the electronic device include setting one or more alarm means, detecting an acceleration and a moving direction of the electronic device using the three-axis accelerometer, and detecting that the electronic device is in a falling state if the acceleration is larger or equal to the acceleration of gravity and the moving direction is in the gravitational direction. The electronic device and method further include activating one or more of the alarm means if the electronic device is in the falling state or if a clip connected with a strap of the electronic device is not in a tightened state.

15 Claims, 3 Drawing Sheets

ELECTRONIC DEVICE AND METHOD TO PREVENT FALLING OF THE ELECTRONIC DEVICE

BACKGROUND

1. Technical Field

Embodiments of the present disclosure relate to protecting an electronic device, and more particularly to an electronic device and method to prevent falling of the electronic device.

2. Description of Related Art

Electronic devices are easily lost by people. Once electronic devices have fallen out from pockets or bags of people, it may cause damage to the electronic device.

What is needed, therefore, is an improved electronic device and method to prevent falling of the electronic device.

DETAILED DESCRIPTION

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

In general, the word "module," as used herein, refers to logic embodied in hardware or firmware, or to a collection of software instructions, written in a programming language, such as, for example, Java, C, or assembly. One or more software instructions in the modules may be embedded in firmware, such as an EPROM. It will be appreciated that modules may comprised connected logic units, such as gates and flip-flops, and may comprise programmable units, such as programmable gate arrays or processors. The modules described herein may be implemented as either software and/or hardware modules and may be stored in any type of computer-readable medium or other computer storage device.

Figure 1:
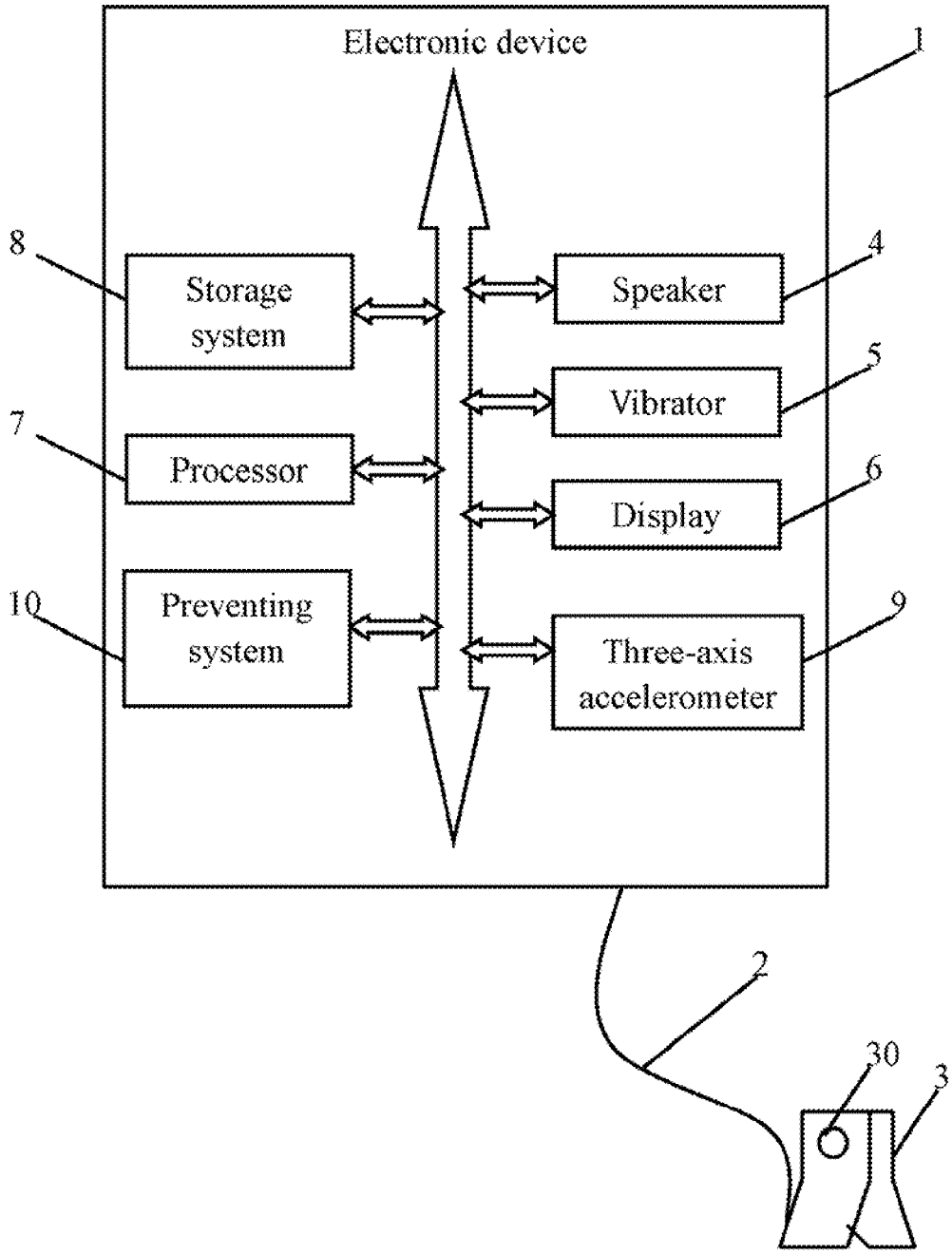
FIG. 1 is a block diagram of one embodiment of an electronic device including a preventing system.

FIG. 1 is a block diagram of one embodiment of an electronic device 1 including a preventing system 10. The preventing system 10 is used to determine if the electronic device 1 is in a falling state, and activate one or more preset alarm means if the electronic device 1 is in the falling state.

The electronic device 1 may be a mobile phone, a personal digital assistant, a handheld computer, or any other kind of handheld computing device. As shown, the electronic device 1 has a strap 2. The strap 2 is connected with at least one clip 3. The strap 2 is made by flexible/elastic wires. To prevent lose of the electronic device 1, the clip 3 may be used to clip onto clothing or handbags, for example. The clip 3 includes a sensor 30 to detect if the clip 3 is in a tightened state or a normal state. If the clip 3 is not in a tightened state, the electronic device 1 may unnoticeably fall out of a pocket of the clothing or the handbags and be lost, for example.

In one embodiment, if the preventing system 10 detects that the clip 3 is not in the tightened state, the preventing system 10 activates one or more preset alarm means. In another embodiment, if the preventing system 10 detects that the clip 3 is in the tightened state and the electronic device 1 is in a falling state, the preventing system 10 generates a control command to frap the strap 2, and activates the one or more preset alarm means.

The electronic device 1 may also include a speaker 4, a vibrator 5, a display 6, a processor 7, a storage system 8, and a three-axis accelerometer 9. The speaker 4 may output audio signals, such as songs, rings, for example. The vibrator 5 may vibrate the electronic device 1 when a vibration mode provided by the electronic device 1 is selected. The display 6 may display various information, such as messages, images, videos, for example. The three-axis accelerometer 9 is used to detect an acceleration and a moving direction of the electronic device 1.

The processor 7 executes one or more computerized operations of the electronic device 1 and other applications, to provide functions of the electronic device 1. The storage system 8 stores one or more programs, such as programs of an operating system, other applications of the electronic device 1, and various kinds of data, such as agendas in the calendar of the electronic device 1, for example. In one embodiment, the electronic device 1 may be a mobile phone, and the storage system 8 may be a memory of the electronic device 1 or an external storage card, such as a memory stick, a subscriber identification module (SIM) card, a smart media card, a compact flash card, or any other type of memory card.

Figure 2:
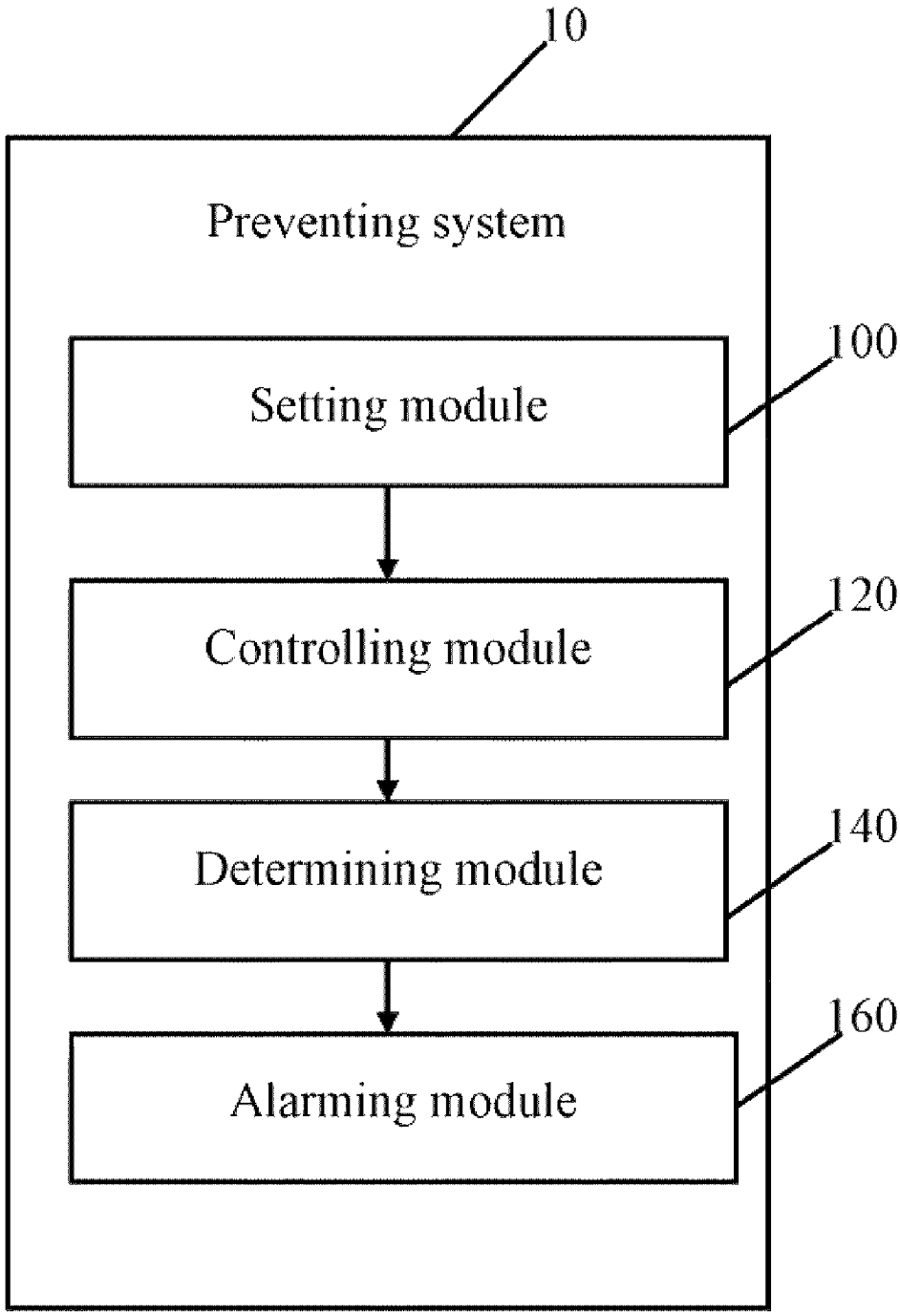
FIG. 2 is a block diagram of one embodiment of the preventing system.

FIG. 2 is a block diagram of one embodiment of the preventing system 10. In one embodiment, the preventing system 10 includes a setting module 100, a controlling module 120, a determining module 140, and an alarming module 160. The modules 100, 120, 140, and 160 may comprise one or more computerized operations to be executed by the processor 7 to perform one or more operations of the electronic device 1. Details of these operations will be provided below.

The setting module 100 sets one or more alarm means to alarm a user of the electronic device 1 when the electronic device 1 is in a falling state or when the clip 3 is not in a tightening state. In one embodiment, the alarm means may include an audible alarm, a vibration alarm, a blinking alarm, and/or any combination of the above-mentioned alarms.

The setting module 100 also sets a hotkey to activate or deactivate the preventing system 10. In one embodiment, the hotkey may be a character string including alphanumeric characters and/or symbols, such as "#detecting#."

The controlling module 120 activates the sensor 30 of the clip 3 to detect if the clip 3 is in the tightened state. If the clip 3 is in the tightened state, the controlling module 120 activates the three-axis accelerometer 9 to detect an acceleration and a moving direction of the electronic device 1. If the clip 3 is not in the tightened state, the alarming module 160 activates one or more of the alarm means.

The determining module 140 determines if the acceleration is larger or equal to the acceleration of gravity and if the moving direction is in the gravitational direction. If the acceleration is larger or equal to the acceleration of gravity and the moving direction is in the gravitational direction, the determining module 140 detects that the electronic device 1 is in a falling state. If the acceleration is less than the acceleration of gravity and/or the moving direction is not in the gravitational direction, the determining module 140 determines that the electronic device 1 is in a normal state.

The alarming module 160 generates a control command to frap the strap 3, and activates one or more of the alarm means if the electronic device 1 is in a falling state. The alarm means include outputting audio alerts through the speaker 4, vibrating the electronic device 1 through the vibrator 5, and/or blinking through the display 6. In one embodiment, the output audio alerts may be a specified song, or specified ring tone.

Figure 3:
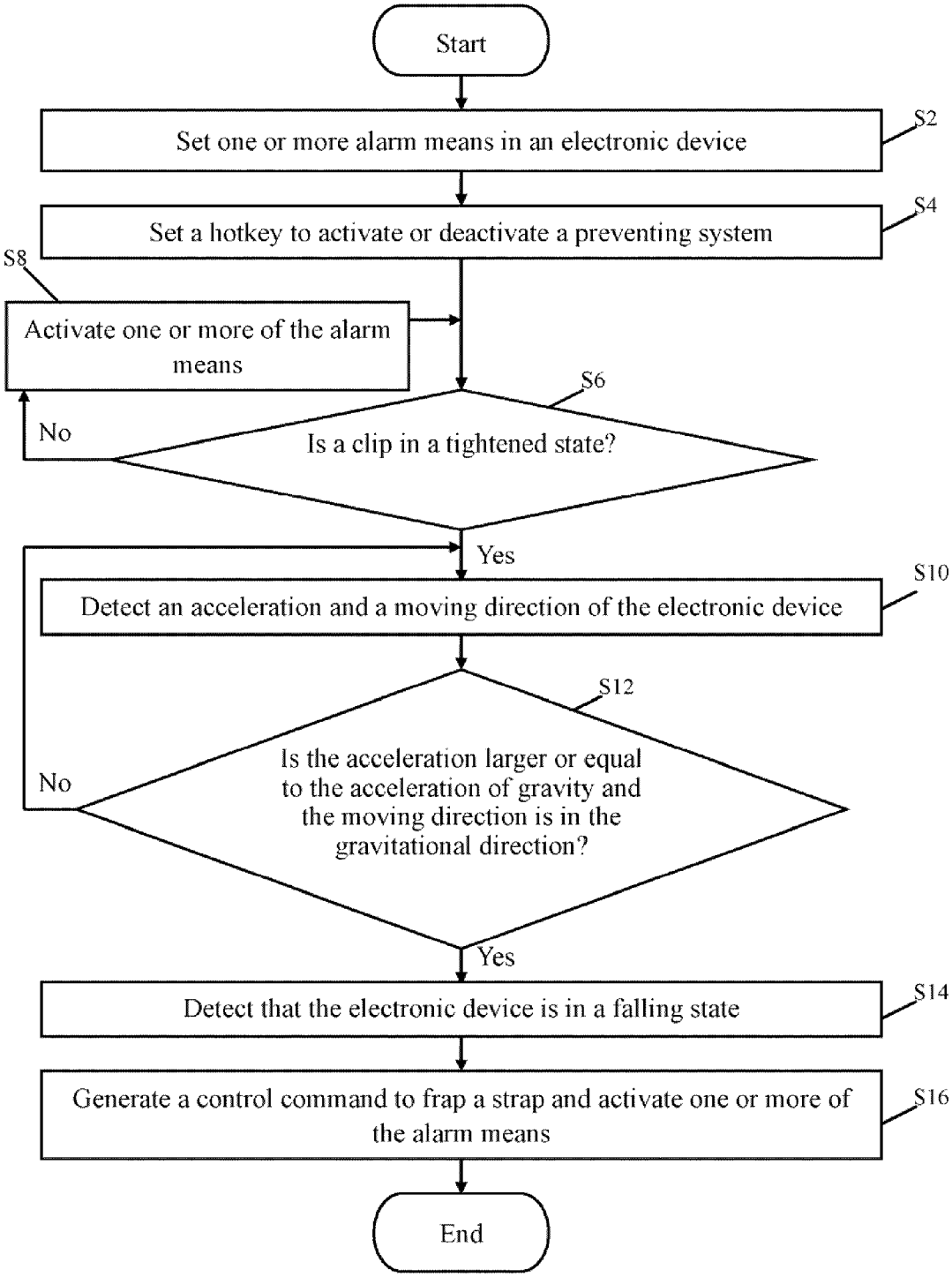
FIG. 3 is a flowchart of one embodiment of a method to prevent falling of the electronic device of FIG. 1.

FIG. 3 is a flowchart of one embodiment of a method to prevent falling of the electronic device 1 of FIG. 1. Depending on the embodiment, additional blocks may be added, others removed, and the ordering of the blocks may be replaced.

In block S2, the setting module 100 sets one or more alarm means to alarm a user of the electronic device 1 when the electronic device 1 is in a falling state or when the clip 3 is not in a tightened state. As mentioned above, the alarm means may include an audible alarm, a vibration alarm, a blinking alarm, and/or any combination of the above-mentioned alarms.

In block S4, the setting module 100 sets a hotkey to activate or deactivate the preventing system 10. As mentioned above, the hotkey may be a character string including alphanumeric characters and/or symbols, such as "#detecting#."

In block S6, the controlling module 120 activates the sensor 30 of the clip 3 to detect if the clip 3 is in the tightened state. If the clip 3 is in the tightened state, the procedure goes to block S10 directly. If the clip 3 is not in the tightened state, in block S8, the alarming module 160 activates one or more of the alarm means.

In block S10, the controlling module 120 activates the three-axis accelerometer 9 to detect an acceleration and a moving direction of the electronic device 1.

In block S12, the determining module 140 determines if the acceleration is larger or equal to the acceleration of gravity and if the moving direction is in the gravitational direction. If the acceleration is less than the acceleration of gravity and/or the moving direction is not in the gravitational direction, the procedure returns to block S10.

If the acceleration is larger or equal to the acceleration of gravity and the moving direction is in the gravitational direction, in block S14, the determining module 140 detects that the electronic device 1 is in a falling state.

In block S16, the alarming module 26 generates a control command to frap the strap 3, and activates one or more of the alarm means, such as outputting audio alerts through the speaker 4, vibrating the electronic device 1 through the vibrator 5, and/or blinking through the display 6. As mentioned above, the output audio alerts may be a specified song, or specified ring tone.

Although certain inventive embodiments of the present disclosure have been specifically described, the present disclosure is not to be construed as being limited thereto. Various changes or modifications may be made to the present disclosure without departing from the scope and spirit of the present disclosure.

What is claimed is:

1. A method to prevent falling of an electronic device, the electronic device comprising a strap, the strap being connected with at least one clip, the method comprising:

setting one or more alarm means;

detecting if the clip is in a tightened state using a sensor in the clip;

activating a three-axis accelerometer in the electronic device if the clip is in the tightened state;

detecting an acceleration and a moving direction of the electronic device using the three-axis accelerometer;

determining if the acceleration is larger or equal to the acceleration of gravity and if the moving direction is in the gravitational direction;

detecting that the electronic device is in a falling state if the acceleration is larger or equal to the acceleration of gravity and the moving direction is in the gravitational direction;

generating a control command to frap the strap; and activating one or more of the alarm means.

2. The method according to claim 1, further comprising:

activating one or more of the alarm means if the clip is not in the tightened state.

3. The method according to claim 1, further comprising:

determining that the electronic device is in a normal state if the acceleration is less than the acceleration of gravity and/or the moving direction is not in the gravitational direction, and returning to the step of detecting an acceleration and a moving direction of the electronic device using the three-axis accelerometer.

4. The method according to claim 1, wherein the one or more alarm means comprise an audible alarm, a vibration alarm, a blinking alarm, and a combination of the audible alarm, the vibration alarm, and/or the blinking alarm.

5. The method according to claim 4, wherein the step of activating one or more of the alarm means comprises:

outputting audio alerts through a speaker of the electronic device;

vibrating the electronic device through a vibrator of the electronic device; and/or blinking through a display of the electronic device.

6. An electronic device, the electronic device comprising:

a strap being connected with at least one clip, each of the at least one clip comprising a sensor;

a three-axis accelerometer;

a storage system;

at least one processor; and one or more programs stored in the storage system and being executable by the at least one processor, the one or more programs comprising:

a setting module operable to set one or more alarm means;

a controlling module operable to activate the sensor of the clip to detect if the clip is in a tightened state, and activate the three-axis accelerometer to detect an acceleration and a moving direction of the electronic device if the clip is in the tightened state;

a determining module operable to determine if the acceleration is larger or equal to the acceleration of gravity and if the moving direction is in the gravitational direction, and detect that the electronic device is in a falling state if the acceleration is larger or equal to the acceleration of gravity and the moving direction is in the gravitational direction; and an alarming module operable to generate a control command to frap the strap, and activate one or more of the alarm means.

7. The electronic device according to claim 6, wherein the alarming module is further operable to activate one or more of the alarm means if the clip is not in the tightened state.

8. The electronic device according to claim 6, wherein the determining module is further operable to determine that the electronic device is in a normal state if the acceleration is less than the acceleration of gravity and/or the moving direction is not in the gravitational direction.

9. The electronic device according to claim 6, wherein the one or more alarm means comprise an audible alarm, a vibration alarm, a blinking alarm, and a combination of the audible alarm, the vibration alarm, and/or the blinking alarm.

10. The electronic device according to claim 9, wherein the alarming module is further operable to output audio alerts through a speaker of the electronic device, vibrate the electronic device through a vibrator of the electronic device, and/or blink through a display of the electronic device.

11. A non-transitory storage medium storing a set of instructions, the set of instructions capable of being executed by a processor to perform a method to prevent falling of an electronic device, the electronic device comprising a strap, the strap being connected with at least one clip, the method comprising:

setting one or more alarm means;

detecting if the clip is in a tightened state using a sensor in the clip;

activating a three-axis accelerometer in the electronic device if the clip is in the tightened state;

detecting an acceleration and a moving direction of the electronic device using the three-axis accelerometer;

determining if the acceleration is larger or equal to the acceleration of gravity and if the moving direction is in the gravitational direction;

detecting that the electronic device is in a falling state if the acceleration is larger or equal to the acceleration of gravity and the moving direction is in the gravitational direction;

generating a control command to frap the strap; and activating one or more of the alarm means.

12. The storage medium as claimed in claim 11, wherein the method further comprises:

activating one or more of the alarm means if the clip is not in the tightened state.

13. The storage medium as claimed in claim 11, wherein the method further comprises:

determining that the electronic device is in a normal state if the acceleration is less than the acceleration of gravity and/or the moving direction is not in the gravitational direction, and returning to the step of detecting an acceleration and a moving direction of the electronic device using the three-axis accelerometer.

14. The storage medium as claimed in claim 11, wherein the one or more alarm means comprise an audible alarm, a vibration alarm, a blinking alarm, and a combination of the audible alarm, the vibration alarm, and/or the blinking alarm.

15. The storage medium as claimed in claim 14, wherein the step of activating one or more of the alarm means comprises:

outputting audio alerts through a speaker of the electronic device;

vibrating the electronic device through a vibrator of the electronic device; and/or blinking through a display of the electronic device.

* * * * *